US005388439A

United States Patent [19]

Miller

[11] Patent Number: 5,388,439

[45] Date of Patent: Feb. 14, 1995

[54] MAGNETIC KEY FOB

[75] Inventor: Joseph T. Miller, Mehlville, Mo.

[73] Assignee: Mocap Incorporated, St. Louis, Mo.

[21] Appl. No.: 935,557

[22] Filed: Aug. 26, 1992

[51] Int. Cl.[6] ..... A44B 15/00

[52] U.S. Cl. ..... 70/456 R; 206/37.1; 206/38.1; 206/818

[58] Field of Search ..... 70/456 R; 206/37.1, 206/38.1, 818

[56] References Cited

U.S. PATENT DOCUMENTS

| | | | |
|---|---|---|---|
| 3,473,648 | 10/1969 | Paluzzi | 70/456 |
| 3,841,121 | 10/1974 | Shevin | 70/456 R |
| 4,166,489 | 9/1979 | Lemelson | 70/456 R X |
| 4,226,105 | 10/1980 | Wehrman | 70/456 R |
| 4,739,877 | 4/1988 | Olson | 206/38.1 |
| 4,789,573 | 12/1988 | Jenkinson | 70/456 R X |
| 4,907,694 | 3/1990 | Miller et al. | 206/37.1 X |
| 4,940,250 | 7/1990 | Carrado | 206/818 X |
| 4,951,819 | 8/1990 | Gebert | 70/456 R X |
| 5,024,078 | 6/1991 | Fenwick | 70/456 R |
| 5,148,916 | 9/1992 | Tillyer, Sr. | 206/818 X |

FOREIGN PATENT DOCUMENTS

| | | | |
|---|---|---|---|
| 1325668 | 3/1963 | France | 70/456 R |
| 288923 | 4/1928 | United Kingdom | 70/456 R |

*Primary Examiner*—Lloyd A. Gall
*Attorney, Agent, or Firm*—Paul M. Denk

[57] ABSTRACT

A magnetic key fob formed as an enclosure member, opening at one end, providing for the insertion of a permanent magnet therein, and having a fastener that connects approximately at the midpoint of the opening into the enclosure member, for permanently retaining the magnet within the fob, and for also securing a key ring to the fob, which key ring may hold a plurality of keys or other weighted items.

1 Claim, 1 Drawing Sheet

MAGNETIC KEY FOB

BACKGROUND OF THE INVENTION

There are a variety of various types of pouches or purses available in the art, fabricated of polymer material such as a plastic, or vinyl, and which are designed for usually holding coins, or the like. The inventor herein has obtained U.S. Pat. No. 4,907,694, upon such a coin pouch, which discloses one such polymer type of pouch, and which even has a clip and ring means provided at its back or arcuately closed end. This particular patent is owned by the same assignee of the current invention herein. In addition, a pouch for holding a mirror is disclosed in U.S. Pat. No. 4,934,528, and it also provides, at its back end, a ring means held by a link or fastener for holding keys to the shown pouch. This patent is also owned by a common assignee to that of the current invention.

Other various prior art devices for holding a key ring to some other instrument, such as shown in the U.S. Pat. No. 4,739,877, comprising a combination key ring and card holder. A key case for holding keys by means of a chain internally of a pouch is shown in U.S. Pat. No. 3,119,429. Other type of key and coin holding devices is shown in the U.S. Pat. No. 2,569,629. A further key and coin holder is disclosed in U.S. Pat. No. 4,166,489. A key case is shown in the Barbara patent No. 1,715,348. The German patent No. 819,964, discloses what appears to be another form of key holding pouch.

The current invention is designed to develop a pouch, in the form of an enclosure means, that may permanently support and hold a magnet therein, with the magnet being fixed in place and prevented from escaping from the enclosure means opening by means of the fastener that holds a key ring to the formed pouch.

SUMMARY OF THE INVENTION

This invention contemplates the formation of a means for suspending for storage a key fob at a location that is readily available to the user, due to the incorporation of a magnetic means therein for providing for the temporary support and holding of the ring containing keys to a metallic surface such as the front or door of a refrigerator, or other metallic supporting surface. More specifically, the pouch of this particular device is formed as an enclosure means, which has an opening at one end, while being closed at all other edges of its periphery. The purpose of the opening simply is to provide for the insertion of a magentic means therein, and then locking that magnetic means within the pouch, to insure its permanent enclosure. Then, the same fastening means performing the locking or closing of the pouch opening, also holds the key containing ring to the pouch, so that the combination of ring and enclosure means, holding the series of keys, which may yet have signficant weight, can be fully supported upon a metallic surface, such as the previously identified refrigerator door, by means of the magnet of substantial strength that is permanently encased within the polymer enclosure means forming the fob of this invention.

Hence, the principal object of this invention is to provide a combination of fob or pouch, forming an enclosure member, for holding a permanent magnet, and having its opening through which the magnet initially inserts and is retained in an enclosed condition, by means of the retainer or fastener that supports the key ring to the fob when assembled.

Still another object of this invention is to provide a magnetic key fob that can be conveniently temporarily secured to a metallic surface, but readily removable as soon as the keys are needed for application and usage.

Still another object of this invention is to provide a pouch for holding a magnet and which has sufficient surface area for having indicia or other advertising data imprinted thereon.

Still a further object of this invention is to provide a convenient means for holding a series of keys, or the like.

These and other objects will become more apparent to those skilled in the art upon reviewing the summary of this invention, and upon undertaking a study of the description of its preferred embodiment, in view of the drawing.

BRIEF DESCRIPTION OF THE DRAWING

In referring to the drawing, FIG. 1 provides an isometric view of the magnetic key fob of this invention, showing the attachment of a plurality of keys thereto, as in phantom line.

DESCRIPTION OF THE PREFERRED EMBODIMENT

Figure 1:
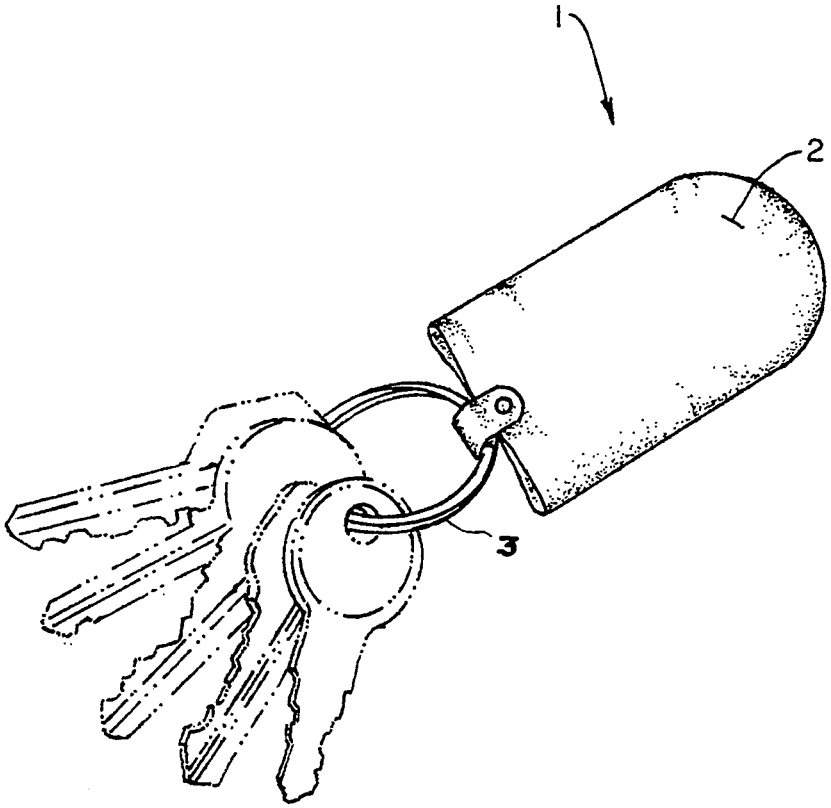

In referring to the drawing, and in particular FIG. 1, the magnetic key fob 1 of this invention is readily disclosed. It comprises a fob enclosure means 2, having a key ring held thereto, as at 3, being secured therewith by means of the fastener 4. The key ring 3 is disposed for holding a plurality of keys, as can be seen, and it has been found that the magnetic fob of this invention may De useful for holding approximately ten to fifteen keys onto a metallic surface, such as the front of a refrigerator, without slippage or disengagement therefrom.

As can be seen, the enclosure member 2 is formed of a polymer, having a shore hardness of between about 70 to 75, and may be formed from polyvinylchloride, or other polymers, or vinyls, to form of the style of fob as disclosed.

Figure 2:
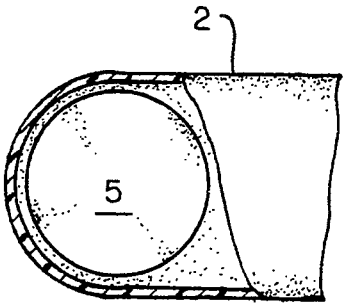
FIG. 2 is a plan view of the fob enclosure, partially broken away to disclose the magnetic retention means held therein.

As can be seen in FIG. 2, a magnetic member, as at 5, is permanently encased within the enclosure member, and has a diameter or size approximating the internal dimensions of the member 2, to provide sufficient strength for magnetic attraction and holding of a heavy key laddened ring to a refrigerator door, or the like.

Figure 3:
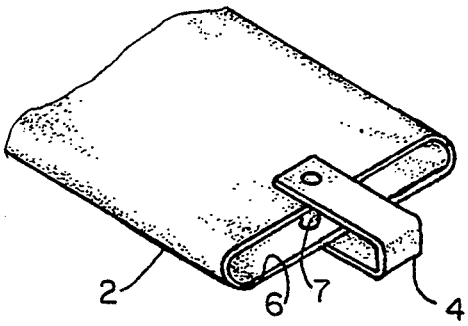
FIG. 3 an end view of the fob enclosure, showing the fastener used to secure the open end into closure, and to hold the key ring thereto.

As can further be seen in FIG. 3, the front of the enclosure member 2 has an opening, as at 6 provided therein, to attain access into the enclosure, to facilitate the insertion of the large permanent magnet 5 therein. Once achieved, a fastening means, such as the fastener 4, is secured by means of its integral pin 7 across the opening, to provide for its closure, and to permanently affix the fastener 4 to the fob, as noted. Then, the key ring 3 will already have been applied to fastener 4, in the manner as shown in FIG. 1, and since the key ring is of the resilient type that allows for the insertion of additional keys thereon, or their removal therefrom, keys can easily be manipulated for added or substitution to this key fob, as required.

As can also be seen in FIG. 1, the surface of the enclosure member 2, being formed of vinyl, may be provided for display of various indicia, or advertising material as can be understood. The material formulations for the polymer used determine what may be essential for the final product with respect to its texture, hardness, color reception, material thickness, in addition to endurance, after sustained usage. Furthermore, the usage of vinyl material in the formation of the enclosure member of this invention allows for the creating of a rather unique molding, that is receptive to any imprinted or bonded message, such as a company name, product advertising, or other designs, into or onto the exposed polymer surface of the fob. Fused glossy inks applied to the polymer surfaces give the appearance of a two part molding, for furnishing a rather lasting impression from this molded device. Any ink applied to this type of vinyl, when fabricated into the fob of this invention, normally resists wear, fading, flexing, or even when it comes in contact with any other chemicals such as to resist deterioration.

The purpose of this development is to provide a means for insertion of a larger strength permanent magnet into the enclosure member, with the magnet having a diameter only slightly less than the opening 6 of the molded fob, to provide the full strength for supporting a plurality of relatively heavy items, such as keys, or other weighted material in the category of fingernail clippers, or the like.

Variations or modifications to the subject matter of this invention may occur to those skilled in the art upon reviewing the disclosure herein. Such variations, if within the scope of this invention, are intended to be encompassed within The scope of any claims to patent protection issuing hereon. The description of the preferred embodiment set forth herein is done so for illustrative purposes only.

Having thus described the invention, what is claimed and desired to be secured by Letters Patent is:

1. A magnetic key fob for use for holding a series of keys and with the fob capable of being adhered to a metallic surface, for temporary storage, including a pouch including an enclosure member having a cavity therein, and further having an entrance opening at one end, said enclosure member being closed at all other locations, said enclosure member being formed of a polymer material, a magnetic means located within the enclosure member, means for retaining keys, said means for retaining keys being connected to the entrance of the enclosure member to provide for retention of the magnetic means therein, and to prevent its unauthorized discharge or removal, said means for retaining keys comprising a ring, and a fastening means connecting the key ring to the enclosure member, while securing the entrance opening of the enclosure member into closure for retention of the magnetic means therein, the entrance opening of the enclosure member provided along one edge thereof, and the fastening means for the ring connected approximately at the midpoint of the entrance opening to secure it into closure and retain the magnetic means within the said enclosure member.

* * * * *